US010107463B1

(12) United States Patent
Hanwell

(10) Patent No.: US 10,107,463 B1
(45) Date of Patent: Oct. 23, 2018

(54) LINKED LIGHTING SYSTEM AND LIGHTING UNIT FOR SAME

(71) Applicant: Pelican Products, Inc., Torrance, CA (US)

(72) Inventor: John Edward Hanwell, Beverly Hills, CA (US)

(73) Assignee: Pelican Products, Inc., Torrance, CA (US)

( * ) Notice: Subject to any disclaimer, the term of this patent is extended or adjusted under 35 U.S.C. 154(b) by 0 days.

(21) Appl. No.: 15/654,638

(22) Filed: Jul. 19, 2017

Related U.S. Application Data

(60) Provisional application No. 62/510,233, filed on May 23, 2017.

(51) Int. Cl.

| | |
|---|---|
| ***F21S 4/20*** | (2016.01) |
| ***F21S 8/00*** | (2006.01) |
| ***F21V 15/01*** | (2006.01) |
| *F21Y 103/10* | (2016.01) |

(52) U.S. Cl.
CPC ..... *F21S 4/20* (2016.01); *F21S 8/032* (2013.01); *F21V 15/01* (2013.01); *F21Y 2103/10* (2016.08)

(58) Field of Classification Search
CPC ..... F21S 4/20; F21S 8/032; F21V 15/01
USPC ..... 362/220, 225, 217.1, 217.12, 249.02, 362/249.03, 249.07, 249.1, 285, 287
See application file for complete search history.

(56) References Cited

U.S. PATENT DOCUMENTS

| | | | | |
|---|---|---|---|---|
| 9,091,423 | B2 * | 7/2015 | Shen | F21V 19/02 |
| 9,546,783 | B2 * | 1/2017 | Lo | F21S 2/005 |
| 9,759,407 | B2 * | 9/2017 | Yang | F21V 14/02 |
| 2010/0165616 | A1 * | 7/2010 | Wilkinson | F21S 2/005 362/231 |
| 2012/0300460 | A1 * | 11/2012 | Liu | F21V 19/02 362/249.02 |
| 2013/0003379 | A1 * | 1/2013 | De Silva | F21S 8/086 362/249.03 |
| 2013/0083518 | A1 * | 4/2013 | De Silva | F21S 8/086 362/225 |

* cited by examiner

*Primary Examiner* — Laura Tso
(74) *Attorney, Agent, or Firm* — Foley & Lardner LLP

(57) ABSTRACT

Systems, apparatuses, and methods are described herein for a lighting system, including but not limited to a light unit. The light unit includes a housing and at least two light bars supported by the housing. Each respective light bar includes one or more light elements configured to shine light in a light field associated with the respective light bar. Each respective light bar is supported for pivotal motion about a respective pivot axis and relative to the housing, to adjustably move the light field associated with the respective light bar in a direction that is non-parallel to the pivot axis of the respective light bar. The light unit further includes an electrical connection configured to provide power to the one or more light elements of each respective light bar.

20 Claims, 14 Drawing Sheets

LINKED LIGHTING SYSTEM AND LIGHTING UNIT FOR SAME

PRIORITY CLAIM

This application is based on U.S. Provisional Patent Application Ser. No. 62/510,233, filed May 23, 2017, which is incorporated herein by reference.

BACKGROUND

A linked lighting system includes multiple light units connected in a series, sequence line, or ring, for example, in a daisy chain or clover chain linked arrangement. A linked lighting system can be employed to provide wide-area illumination by virtue of linking separate light units with a common power source. A conventional daisy chain lighting system includes multiple light units, where each light unit has one or more light elements fixed in and relative to a housing of the light unit. Once the housing of a light unit is mounted in a fixed location, light fields for the light unit tend to be fixed and cannot be adjusted without moving the entire light unit housing.

DETAILED DESCRIPTION

The construction and arrangement of the systems and methods as shown in the various exemplary arrangements are illustrative only. Although only a few arrangements have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary arrangements without departing from the scope of the present disclosure.

Figure 1:
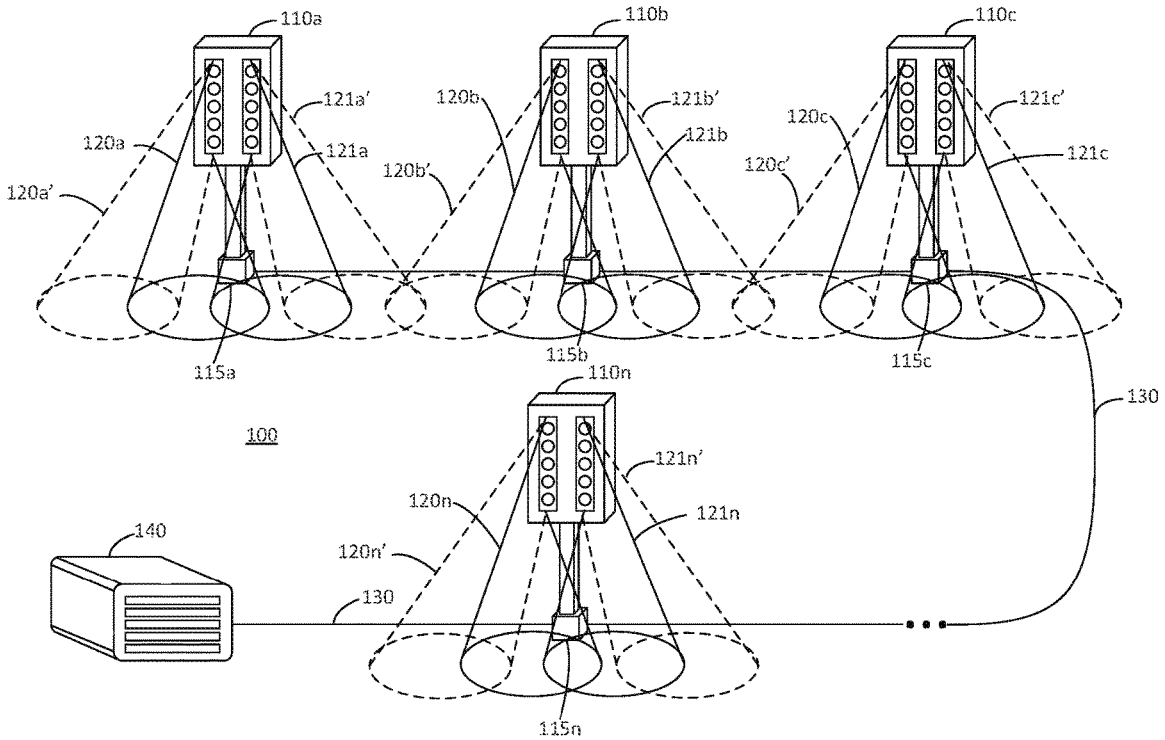
FIG. 1 is a diagram illustrating a lighting system according to some implementations.

FIG. 1 is a diagram illustrating a lighting system 100 according to some implementations. Referring to FIG. 1, the lighting system 100 may include one or more light units (e.g., light units 110*a*-110*n*). Each of the light units 110*a*-110*n* may be supported by a respective one of the support structures 115*a*-115*n*. Each of the support structures 115*a*-115*n* may be secured or otherwise attached to a respective one of the light units 110*a*-110*n* to support the respective one of the light units 110*a*-110*n* in desired positions and orientations. For instance, one or more users of the lighting system 100 can place the light units 110*a*-110*n* in desired positions and orientations by placing a respective one of the support structures 115*a*-115*n* accordingly.

As shown, each of the support structures 115*a*-115*n* may include a stand, such as, but not limited to a pole, tripod, or other support structure for holding a light unit at a vertical height above a ground or floor surface. Other implementations of the support structures 115*a*-115*n* can include any suitable stationary or mobile platform configured to support the light units 110*a*-110*n*. For example, other implementations of the support structures 115*a*-115*n* can include brackets attachable to a fence, wall, another type of surface for simple deployment. In some arrangements, one or more of the support structures 115*a*-115*n* can be secured or otherwise attached to a respective one of the light units 110*a*-110*n* via screws, latches, adhesives, clamps, fasteners, magnets, and/or the like. In some arrangements, quick-release attachment elements (e.g., quick-release clamps) may be employed to attach one of the light units 110*a*-110*n* to each of one or more (or all) of the support structures 115*a*-115*n*, for expedited assembly and disassembly.

Each of the light units 110*a*-110*n* may be linked together in a daisy chain configuration. For example, one or more wires (e.g., a wire 130) may supply power to the light units 110*a*-110*n*. In some arrangements, the wire 130 may refer to a plurality of separate wires. Each separate wire may connect at least two of the light units 110*a*-110*n* and/or at least two of the support structures 115*a*-115*n*.

As shown, the wire 130 may connect to each of the support structures 115*a*-115*n*. Power carried by the wire 130 can be relayed to each of the light units 110*a*-110*n* through a respective one of the support structures 115*a*-115*n*. In other arrangements, the wire 130 can directly connect to one or more of the light units 110*a*-110*n*. In some arrangements, control signals that control characteristics (e.g., intensity, mode, and the like) of light elements on the light units 110*a*-110*n* can be conveyed by the wire 130 or another suitable wire. A processing circuit used to control such characteristics may be electrically coupled to the light units 110*a*-110*n* by the wire 130 or the another suitable wire. The processing circuit may include a processor and a memory. In some arrangements, the processing circuit may include a user interface (e.g., a keyboard, a mouse, a touchscreen, dials, buttons, switches, and/or the like) for receiving user input corresponding to user-set characteristics.

A power supply 140 may supply power to the light units 110*a*-110*n* in some arrangements. The power supply 140 can be one or more of a generator, a battery, a connection to an AC power source or other external power source, and the like. In some arrangements, an additional power supply (such as, but not limited to, the power supply 140) can be added to supply power to the light units 110*a*-110*n*. In some arrangements, one or more of the light units 110*a*-110*n* may have a dedicated power supply, for example in or on the light unit housing or coupled to the light unit housing.

Each of the light units 110*a*-110*n* may include light elements that generate one or more associated light fields (e.g., light fields 120*a*-120*n* and 121*a*-121*n*) when the light elements are switched on. As used herein, a light field refers to a shape composed by beams of light radiating from at least one light. As discussed in further details herein, each of the light units 110*a*-110*d* may include one or more light bars. Each light bar may include one or more light elements. The one or more light elements on a light bar can radiate light in a general light field. In other words, each separate light bar is associated with a general light field. Illustrating with a non-limiting example, light elements on a first light bar on the light unit 110*a* radiate light in a light field 120*a*, and light elements on a second light bar on the light unit 110*a* radiate light in a light field 121*a*.

In some arrangements, at least one light bar of each of the light units 110*a*-110*n* can be adjusted relative to the housing of the light unit, to adjust light fields for one or more (or each) of the light units 110*a*-110*n*. For instance, a light bar is supported for rotational or pivotal motion about a pivot axis for adjusting the direction or position of an associated light field. Relative to a light unit (e.g., the light unit 110*a*) having two or more light bars, adjusting the light bars corresponds to adjusting the direction or position of a combined light field associated with the light unit. The combined light field associated with the light unit 110*a* includes the light fields 120*a* and 121*a*. Pivoting the light bars to increase overlap between the light fields 120*a* and 121*a* narrows the width of the combined light field, and increases intensity with respect to the overlap region without moving the light unit 110*a* itself. On the other hand, moving the light bars to separate the light fields 120*a* and 121*a* broadens the width of the combined light field at the expense of decreased intensity due to decreased overlap. In some arrangements, the light fields (e.g., the light fields 121*a* and 120*b*) of adjacent light units (e.g., light units 110*a* and 110*b*) can overlap corresponding to pivot angles of respective light bars. In other arrangements, the light fields of adjacent light units may not overlap.

As shown in the non-limiting example illustrated in FIG. 1, the light field 120*a* can be adjusted to a new position (a light field 120*a*') by adjusting a pivot angle of a corresponding light bar of the light unit 110*a*. The light field 121*a* can be adjusted to a new position (a light field 121*a*') by adjusting a pivot angle of a separate light bar of the light unit 110*a*. Light fields 120*b*, 121*b*, 120*c*, 121*c*, 120*n*, and 121*n* can be similarly adjusted to new positions (a light fields 120*b*', 121*b*', 120*c*', 121*c*', 120*n*', and 121*n*', respectively). As shown, the light fields 120*a*' and 121*a*' of the light unit 110*a* may not overlap with one another. The light fields 121*a*' and 120*b*' of different light units 110*a* and 110*b* may overlap with one another. In some arrangements, the angle of the light fields 120*a* and 121*a* can be adjusted such that the light fields 120*a* and 121*a* overlap to form a contiguous area of light, or are spaced apart such that the light fields 120*a*' and 121*a*' form two separated areas of light. In some arrangements, the angle of the light fields (e.g., the light fields 121*a*' and 120*b*') of adjacent light units (e.g., the light units 110*a* and 110*b*) can be adjusted such that the light fields (e.g., the light fields 121*a*' and 120*b*') overlap to form a contiguous area of light. One of ordinary skill in the art can appreciate that the non-limiting example shown in FIG. 1 is illustrative in nature, and that the angles of the light bars can be adjusted to adjust the position of the light fields of the same or different light units to overlap substantially (e.g., 50% or more), overlap minimally (e.g., less than 50%), overlap at various amounts, touch but do not overlap, or be spaced apart at various distances.

Thus, the daisy chain configuration of the lighting system 100 is associated with an aggregate light field that includes the combined light fields associated with each of the light units 110*a*-110*n* in the system. In other words, the aggregate light field includes the light fields 120*a*-120*n* and 121*a*-121*n*. As shown, the position and orientation of the light units 110*a*-110*n* also affect the aggregate light field. That is, the aggregate light field for the lighting system 100 is a function of the position and orientation of the light units 110*a*-110*n* as well as the direction and orientation of one or more individual light fields associated with each light bar arranged on the light units 110*a*-110*n*. One or more users of the lighting system 100 can adjust the position and orientation of the light units 110*a*-110*n*, to accommodate a desired lighting pattern. The users can also adjust the individual light fields by manipulating (e.g., pivoting) a corresponding light bar in the manner described.

Figure 2A:
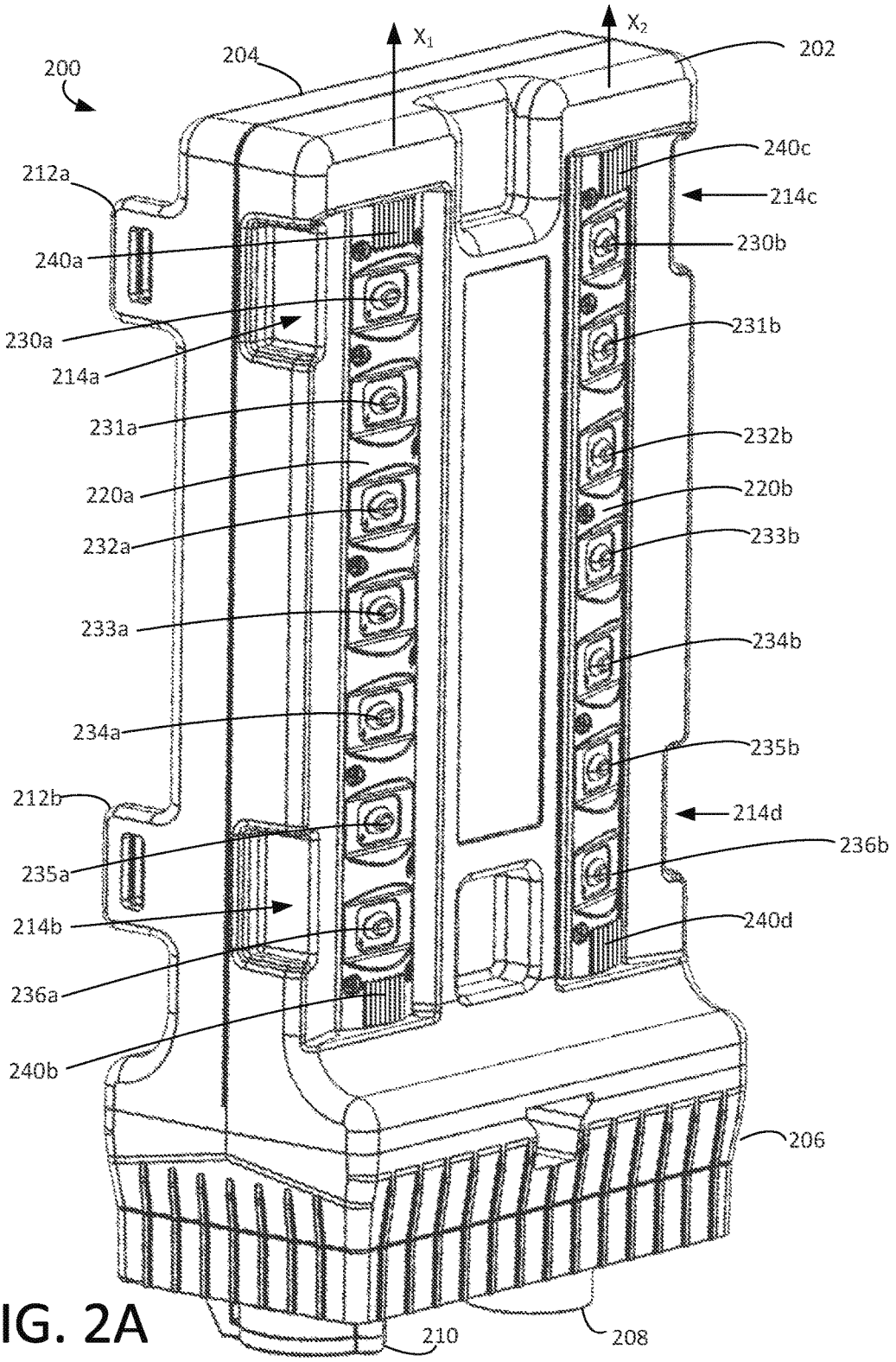
FIG. 2A shows a perspective view of a light unit according to some implementations.
Figure 2B:
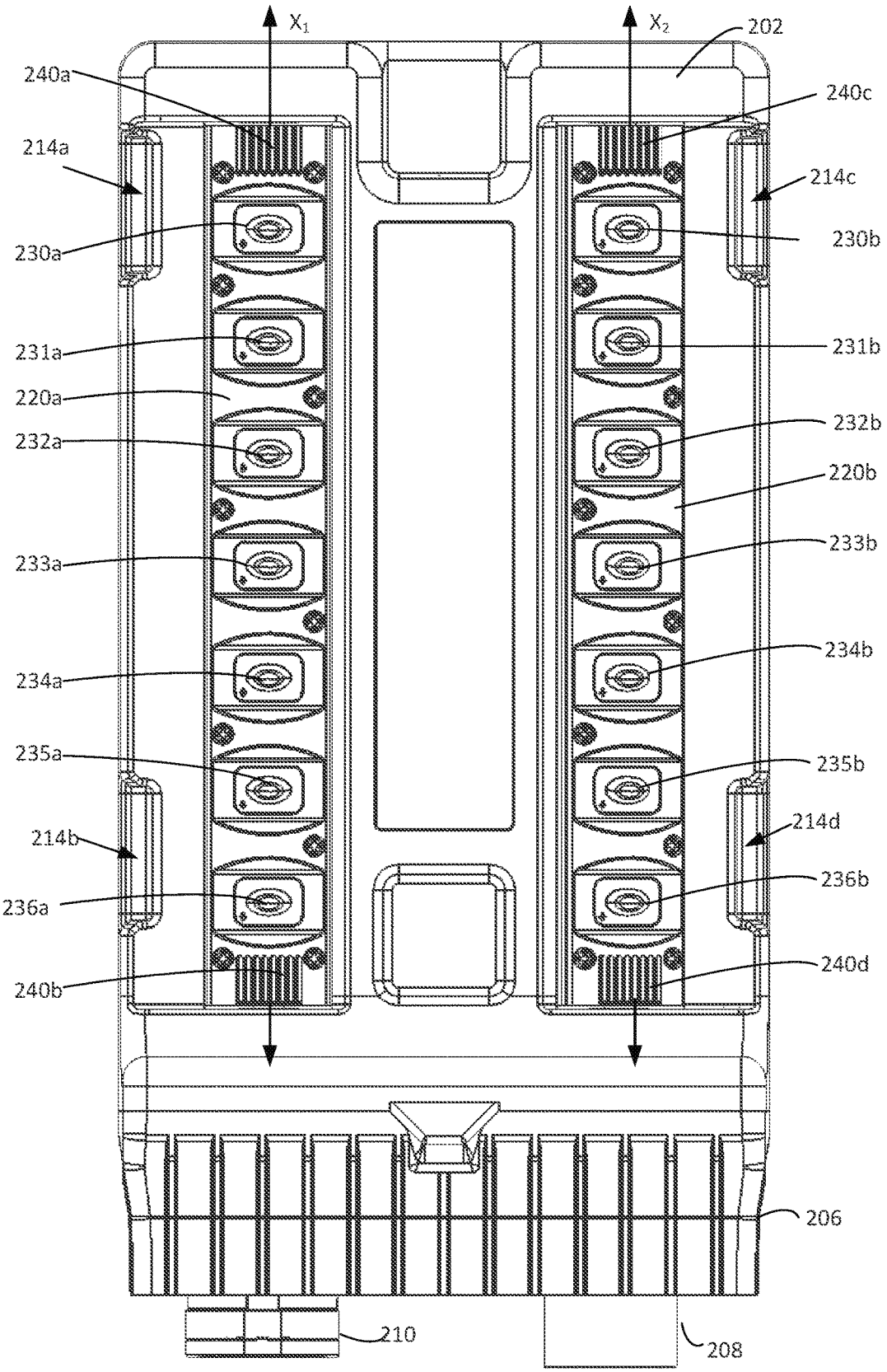
FIG. 2B shows a front view of a light unit according to some implementations.
Figure 2C:
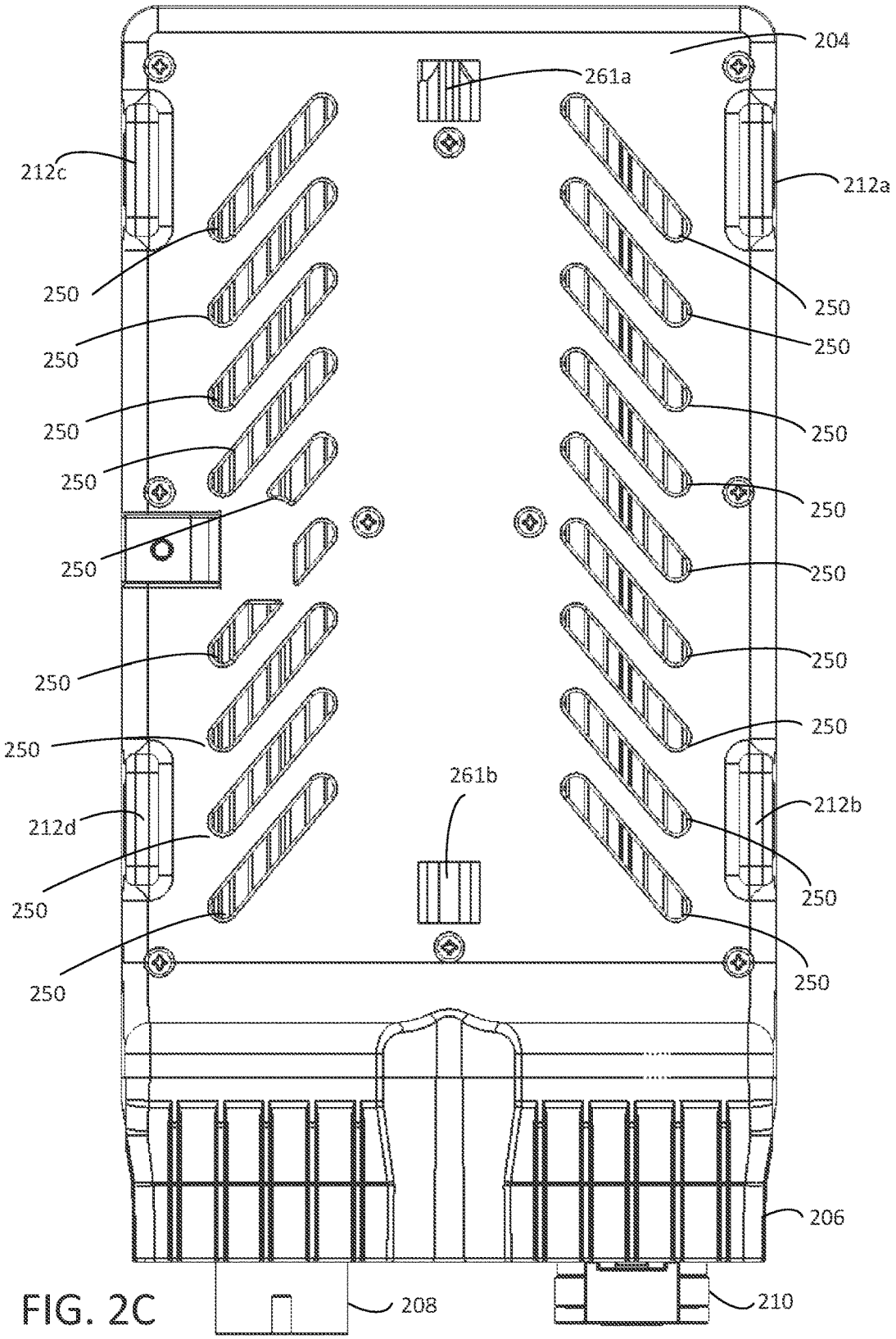
FIG. 2C shows a back view of a light unit according to some implementations.
Figure 2D:
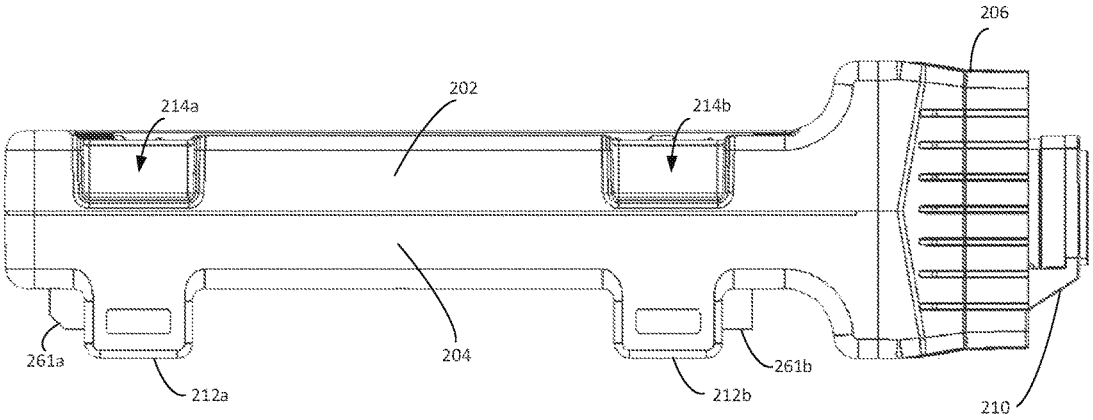
FIG. 2D shows a side view of a light unit according to some implementations.
Figure 2E:
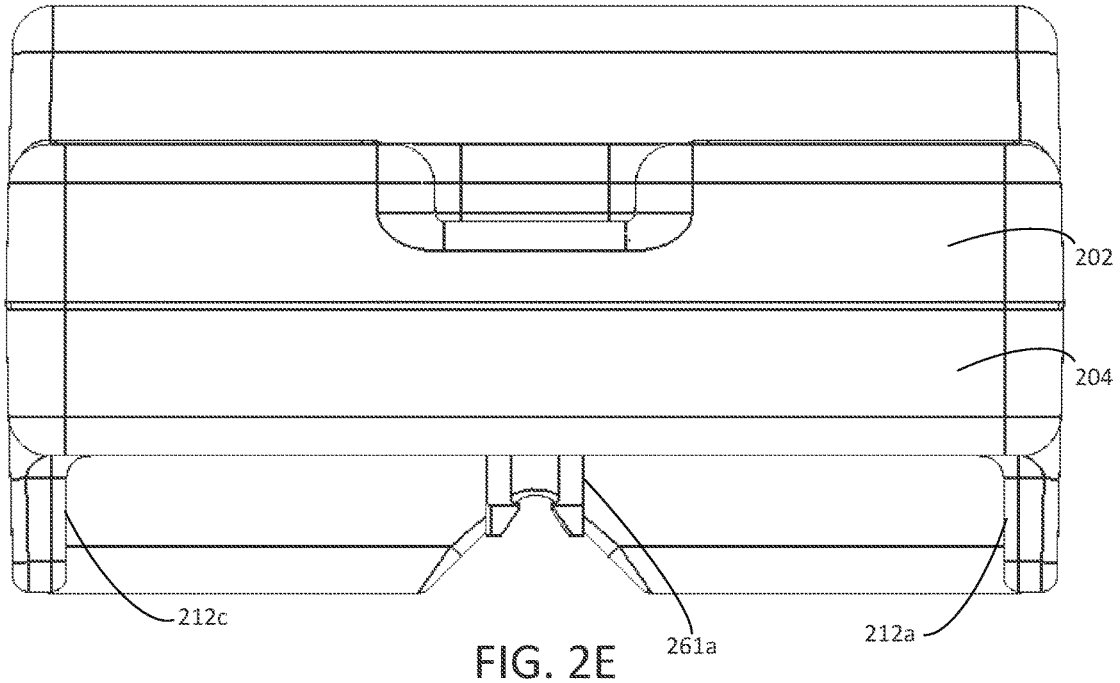
FIG. 2E shows an end view of a light unit according to some implementations.
Figure 2F:
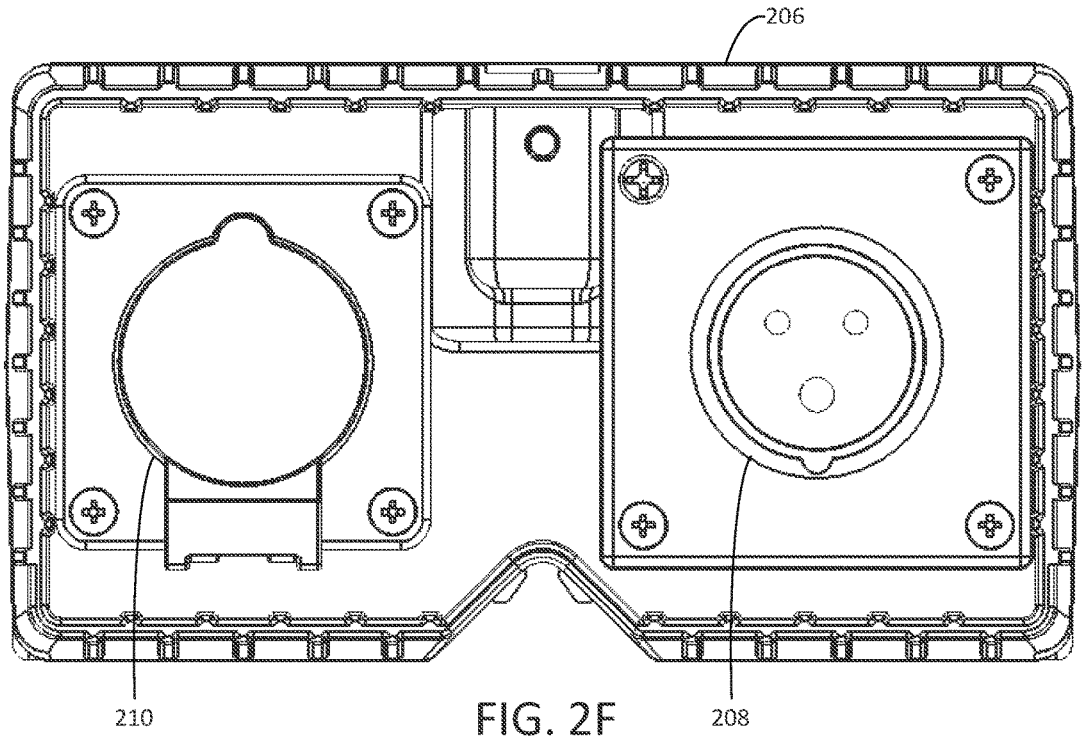
FIG. 2F shows another end view of a light unit according to some implementations.

FIG. 2A shows a perspective view of a light unit 200 according to some implementations. FIG. 2B shows a front view of a light unit 200 according to some implementations. FIG. 2C shows a back view of a light unit 200 according to some implementations. FIG. 2D shows a side view of a light unit 200 according to some implementations. FIG. 2E shows an end view of a light unit according to some implementations. FIG. 2F shows another end view of a light unit 200 according to some implementations. The light unit 200 is an example of a particular implementation of each of one or more of the light units 110*a*-110*n*.

The light unit 200 may include a housing composed of a first housing portion 202 and a second housing portion 204. In some arrangements, the first housing portion 202 and the second housing portion 204 may be secured or otherwise attached together via screws, latches, adhesives, clamps, fasteners, magnets, and/or the like. In other arrangements, the first housing portion 202 and the second housing portion 204 may be two inseparable portions of a unitary housing structure. Each of the first housing portion 202 and the second housing portion 204 may be made from a generally rigid material. In some arrangements, each of the first housing portion 202 and the second housing portion 204 may be made from a suitable material such as, but not limited to one or more of plastic, resin, rubber, metal, composite material and/or the like.

As shown, the light unit 200 may include a first light bar 220*a* and a second light bar 220*b*. One of ordinary skill in the art can appreciate that different examples of the light unit

200 may include one, two, three, or more light bars (where two light bars 220*a* and 220*b* are shown in the example of the present drawings). Each of the light bars 220*a* and 220*b* may have an elongated shape defining a length-wise dimension along pivot axes $X_1$ or $X_2$, respectively. The pivot axes $X_1$ and $X_2$ may be parallel to one another in some arrangements. In other examples, the pivot axes $X_1$ and $X_2$ may be non-parallel. The pivot axes $X_1$ and $X_2$ may be perpendicular (or substantially perpendicular) to a ground or a flat surface when the light unit 200 is supported in an upright position on the ground, on a flat surface or on a support structure 115*a* or the like. Movable light bars of other suitable shapes, positions, and orientations relative to the light unit 200 can be likewise implemented.

The light bars 220*a* and 220*b* may be supported by the housing of the light unit 200. For example, each of the light bars 220*a* and 220*b* may be supported by one or both of the first housing portion 202 and the second housing portion 204 to enable rotational motion or pivotal motion of the light bars 220*a* and 220*b* about the pivot axes $X_1$ and $X_2$, respectively, relative to the housing of the light unit 200. The first light bar 220*a* may include light elements 230*a*-236*a*. In some arrangements, the light elements 230*a*-236*a* may be fixed relative to the light bar 220*a*. The second light bar 220*b* may include light elements 230*b*-236*b*. In some arrangements, the light elements 230*b*-236*b* may be fixed relative to the light bar 220*b*. Each of the light elements 230*a*-236*a* and 230*b*-236*b* may be a Light Emitting Diode (LED), a fluorescent light, an incandescent light, or other suitable light emitting device. In some arrangements, each light bar 220*a* or 220*b* also includes one or more of a reflector, a lens, and an electrical connection.

In some arrangements, light elements may be arranged in any suitable manner on a light bar, including in one or more rows along, parallel, or non-parallel to an associated pivot axis, in one or more rings, and the like. In that regard, the light bar may be shaped differently to support the configuration of the light elements. In the non-limiting example shown, the light elements 230*a*-236*a* may be configured and arranged in an array on the light bar 220*a*. For example, the light elements 230*a*-236*a* may be arranged in a row along or parallel to the pivot axis $X_1$. In the non-limiting example shown, the light elements 230*b*-236*b* may be configured in an array on the light bar 220*b*. The light elements 230*b*-236*b* may be arranged in a row along or parallel to the pivot axis $X_2$.

In some arrangements, the light elements 230*a*-236*a* may be configured and arranged on the light bar 220*a* in a manner that is the same as the manner in which the light elements 230*b*-236*b* are configured and arranged on the light bar 220*b*. In other arrangements, the light elements 230*a*-236*a* and the light elements 230*b*-236*b* may be configured or arranged differently on the light bar 220*a* and the light bar 220*b*, respectively. In some arrangements, light elements (e.g., the light elements 230*a*-236*a*) on a same light bar (e.g., the light bar 220*a*) may face the same direction to emit light beams in generally parallel paths. In other arrangements, two or more of light elements (e.g., two or more of the light elements 230*a*-236*a*) on a same light bar (e.g., the light bar 220*a*) may face non-parallel directions, and emit light beans in non-parallel directions, relative to each other.

In some arrangements, the light bars 220*a* and 220*b* may include dials, knobs, grips, handles, push surfaces or other manually interactive elements for allowing a user to manually manipulate the light bars 220*a* and 220*b* to cause pivotal motion to adjust the direction and location of associated light fields. The associated light fields may be adjustably moved in a direction that is non-parallel to the pivot axes $X_1$ and $X_2$. For example, corresponding to the pivotal motion of the light bar 220*a*, an associated light field (e.g., the light field 120*a*) can be moved along a first arc defined by rotary movement of the light bar 220*a* about the pivot axis $X_1$. Corresponding to the pivotal motion of the light bar 220*b*, an associated light field (e.g., the light field 120*b*) can be moved along a second arc defined by rotary movement of the light bar 220*b* about the pivot axis $X_2$. The closer together the light bars 220*a* and 220*b* are to each other, the closer the first and second arcs are to each other. In some arrangements, the first arc and/or the second arc can be substantially or almost linear such that the first arc and/or the second arc may be transverse to the pivot axes $X_1$ and $X_2$, respectively.

The light bar 220*a* may include ribbed or roughened surfaces or dials 240*a* and 240*b* arranged on either end of the light bar 220*a* to allow a user to manually engage the surface with a thumb, finger or tool and rotate (pivot, or tilt) the light bar 220*a* about the pivot axes $X_1$. Similarly, the light bar 220*b* may include ribbed or roughened surfaces or dials 240*c* and 240*d* arranged on either end of the light bar 220*b* to allow a user to rotate, pivot, or tilt the light bar 220*b* about the pivot axes $X_1$. Accordingly, the light bars 220*a* and 220*b* can rotate (pivot or tilt), or otherwise move relative to the housing of the light unit 200 to adjust associated light fields. In some arrangements, one or more of the dials 240*a*-240*d*, the housing (e.g., the first housing portion 202), and the light bars 220*a* and 220*b* may have markings, indicators, symbols, and/or the like configured to indicate a pivot angle of the light bars 220*a* and 220*b* relative to the housing. For instance, marking can be configured to show angular displacement (in degrees or otherwise) relative to a straight-forward direction. In one non-limiting example, the marking can show degrees (e.g., between 0°-90°, and particularly within 20° in some arrangements) to right or left (or both) relative to the straight-forward direction. The straight-forward direction may be perpendicular to pivot axes $X_1$ and $X_2$ in some arrangements. In some arrangements, the straight-forward direction may be perpendicular to a surface of the first housing portion 202. The surface of the first housing portion 202 may refer to a front surface shown in FIG. 2B in some examples. The front surface may include openings that expose the lights 230*a*-236*a* and 230*b*-236*b* on the light bars 220*a* and 220*b*.

Thus, the direction and location of the light field associated with a light bar (e.g., the light bar 220*a*) may be a function of one or more of a direction in which each light element (e.g., each of the light elements 230*a*-236*a*) faces, the reflector shape for each light element, the lens properties for each light element, and the orientation (e.g., the tilt, rotation, or pivot) of the light bar itself relative to the housing of the light unit (e.g., the light unit 200). The light bars 220*a* and 220*b* can be moved to face parallel directions or non-parallel directions relative to each other, by moving the dials 240*a*-240*d* accordingly.

The light unit 200 may include a power box 206. The power box 206 may convey power (e.g., from the power supply 140) to the lights 230*a*-236*a* and 230*b*-236*b*. For instance, the power box 206 may include a first electrical connection 208 configured to connect to a power-carrying wire (e.g., the wire 130 or a conductor thereof) for receiving the power. The power box 206 may include a second electrical connection 210 that connects to a power-carrying wire (e.g., the wire 130 or another conductor thereof) for passing the power to a next light unit on the daisy chain, if any. In other arrangements, instead of the power box 206, the light unit 200 may include a battery.

In some arrangements, the power box 206 may be secured or otherwise attached to one or both of the first housing portion 202 and the second housing portion 204 via screws, latches, adhesives, clamps, fasteners, magnets, and/or the like. In some arrangements, the power box 206 may further serve as a point of attachment between the light unit 200 and a support structure (e.g., one of the support structures 115*a*-115*n*). For example, the power box 206 may include screws, latches, adhesives, clamps, fasteners, magnets, and/or the like for securing or otherwise attaching to the support structure.

The first housing portion 202, the second housing portion 204, and the power box 206 may be collectively referred to as a housing of the light unit 200. In other examples, the power box 206 may be on a separate structure or housing coupled to the housing of the light unit 200. In some arrangements, components of the light unit 200 (such as, but not limited to, the housing portion 202, the second housing portion 204, and the power box 206) may be made from water proof material that allow the light unit 200 to operate in outdoor environments, including weather conditions such as rain and snow, and/or are sealed to allow underwater usage of the light unit 200.

In some arrangements, the housing may include a driver (not shown) connected to the first electrical connection 208, the second electrical connection 210, and the light elements 230*a*-236*a* and 230*b*-236*b* to regulate power to the light elements 230*a*-236*a* and 230*b*-236*b*. The driver may include a circuit board (e.g., a Printed Circuit Board (PCB)) configured to control characteristics such as, but not limited to, intensity, color, mode, and the like of light elements 230*a*-236*a* and 230*b*-236*b*. In some arrangements, the housing may support a converter, such as an AC to DC converter or other suitable power converter.

In some arrangements, the light unit 200 may include mating features that allow the light unit 200 to mate with one or two first additional light units (such as, but not limited to, another light unit 200) such that the light unit 200 and the one or two first additional light unit can be stacked and transported and/or stored together with ease. In particular embodiments, multiple (two or more) light units may be stacked together. For example, the light unit 200 may include grooves 214*a*-214*d* and extensions 212*a*-212*d*. The grooves 214*a*-214*d* may be configured to receive extensions (such as, but not limited to, the extensions 212*a*-212*d*) of the first additional light unit when aligned. When the extensions of the first additional light unit have been inserted into the grooves 214*a*-214*d*, the light unit 200 and the first additional light unit are structurally mated in a stacked configuration such that movement of one of the units relative to another one of the units is hindered or prevented. The extensions 212*a*-212*d* of the light unit 200 may be configured to be inserted into grooves (such as, but not limited to, the grooves 214*a*-214*d*) of a second additional light unit. Other attachment components may be included on or with the light units such as, but not limited to, Velcro, straps, clamps, latches, fasteners, magnets, and/or the like, to further secure the light units together, when stacked. Accordingly, such features allow stacking of multiple light units for transportation or storage, without requiring additional overhead (e.g., boxes, ropes, and the like). The stacking features can be especially useful in portable daisy chain lighting systems (e.g., the lighting system 100) in which a number (in some cases, a relatively large number) of lighting units 110*a*-110*n* may be transported to or from designated areas (usage sites). In some arrangements, when the light units (each of which may be the light unit 200) are stacked together, an operator can add a carry strap to tie the light units together for portability.

In some arrangements, the second housing portion 204 may include one or more openings or vents 250 for heat dissipation. The second housing portion 204 may include wire management features (e.g., clamps 261*a* and 261*b* or other wire retainers) for retaining a wire (e.g., the wire 130 or a segment thereof) that powers the light elements 230*a*-236*a* and 230*b*-236*b*.

Figure 3A:
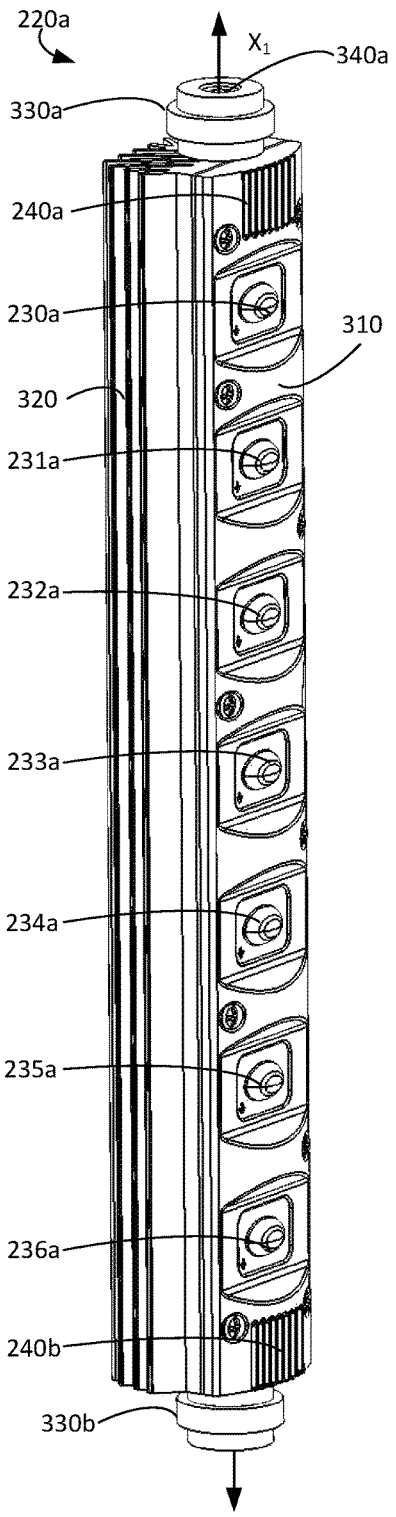
FIG. 3A shows a perspective view of a light bar supported by the light unit (FIGS. 2A-2F) according to some implementations.
Figure 3B:
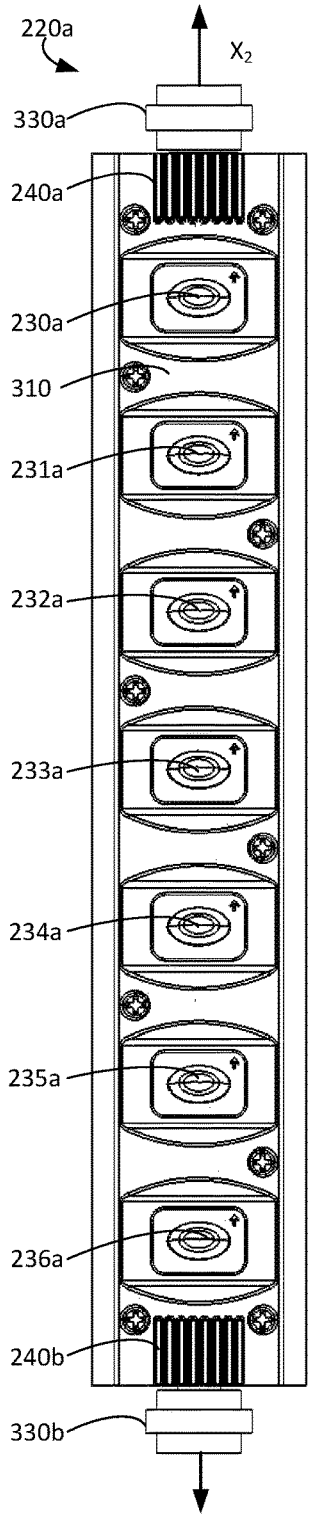
FIG. 3B shows a front view of a light bar supported by the light unit (FIGS. 2A-2F) according to some implementations.
Figure 3C:
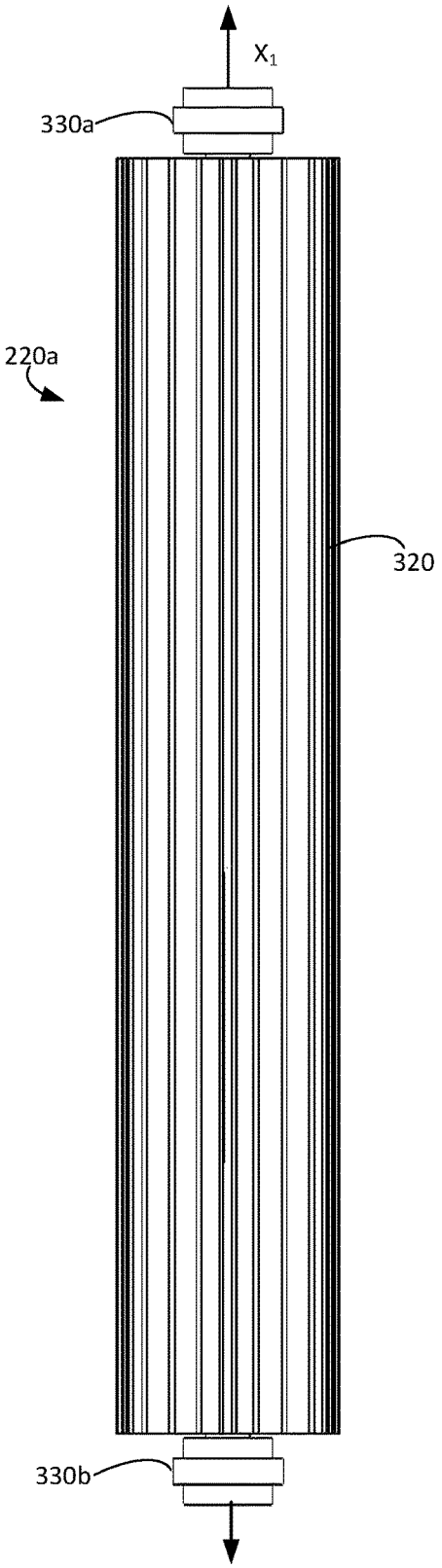
FIG. 3C shows a back view of a light bar supported by the light unit (FIGS. 2A-2F) according to some implementations.
Figure 3D:
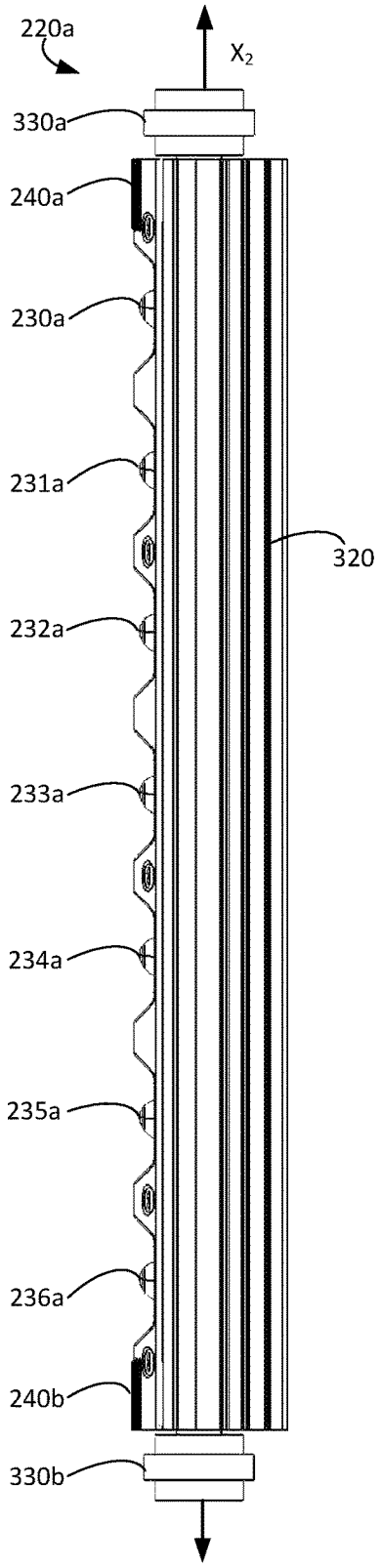
FIG. 3D shows a side view of a light bar supported by the light unit (FIGS. 2A-2F) according to some implementations.
Figure 3E:
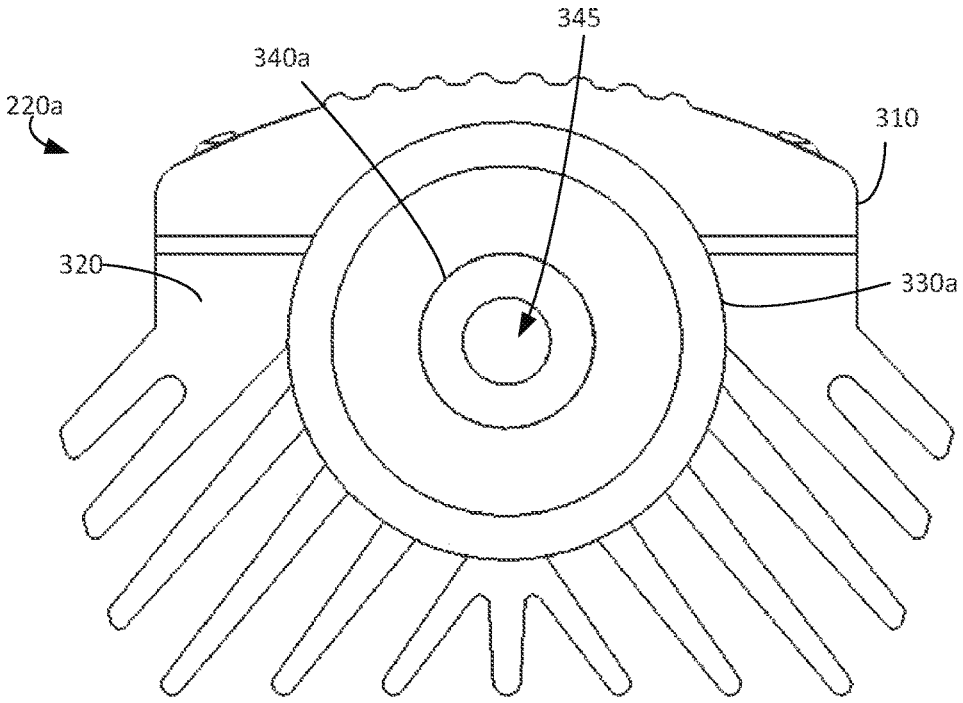
FIG. 3E shows an end view of a light bar supported by the light unit (FIGS. 2A-2F) according to some implementations.
Figure 3F:
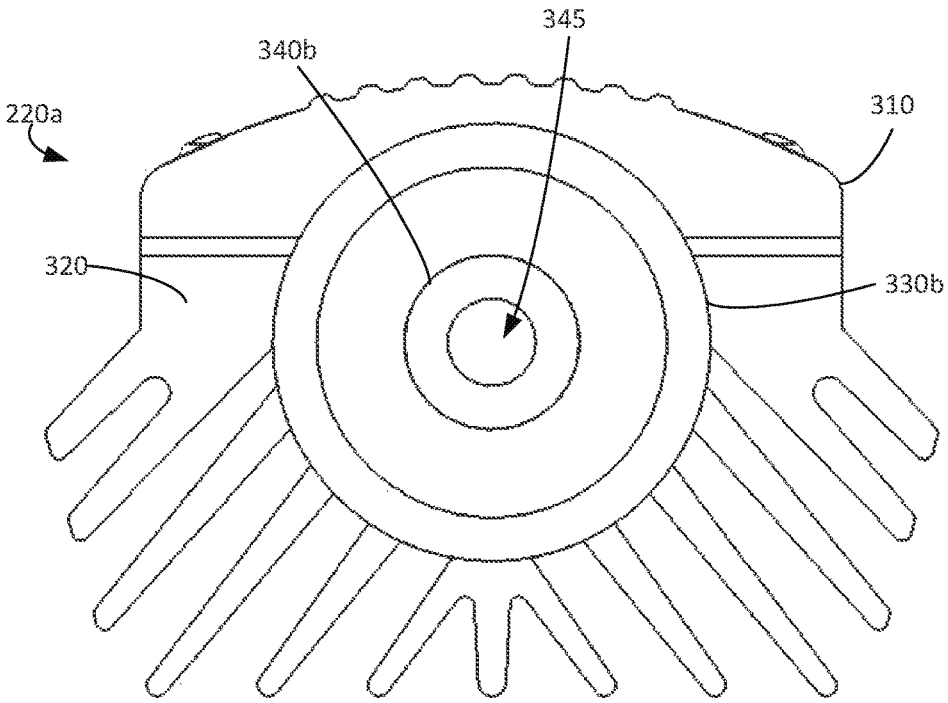
FIG. 3F shows an end view of a light bar supported by the light unit (FIGS. 2A-2F) according to some implementations.

FIG. 3A shows a perspective view of the light bar 220*a* (FIGS. 2A-2F) supported by the light unit 200 (FIGS. 2A-2F) according to some implementations. FIG. 3B shows a front view of the light bar 220*a* (FIGS. 2A-2F) supported by the light unit 200 (FIGS. 2A-2F) according to some implementations. FIG. 3C shows a back view of the light bar 220*a* (FIGS. 2A-2F) supported by the light unit 200 (FIGS. 2A-2F) according to some implementations. FIG. 3D shows a side view of the light bar 220*a* (FIGS. 2A-2F) supported by the light unit 200 (FIGS. 2A-2F) according to some implementations. FIG. 3E shows an end view of the light bar 220*a* (FIGS. 2A-2F) supported by the light unit 200 (FIGS. 2A-2F) according to some implementations. FIG. 3F shows an end view of the light bar 220*a* (FIGS. 2A-2F) supported by the light unit 200 (FIGS. 2A-2F) according to some implementations. Referring to FIGS. 1-3F, the FIGS. 3A-3F illustrate a non-limiting implementation of the light bar 220*a*. The light bar 220*b* may be implemented in a same, similar, or different manner.

In some arrangements, the light bar 220*a* may include a first light bar portion 310 and a second light bar portion 320. The first light bar portion 310 is configured to support the light elements 230*a*-236*a*. In addition, the first light bar portion 310 may support one or more of a reflector, a lens, and an electrical connection associated with each of the light elements 230*a*-236*a*. The first light bar portion 310 may be made from a suitable material such as, but not limited to plastic, resin, rubber, metal, and/or the like.

The light bar 220*a* may include a second light bar portion 320 configured as a heat sink. The second light bar portion 320 can absorb heat generated by the light elements 230*a*-236*a* for cooling. As shown, the second light bar portion 320 may have fins that provide surface area for cooling the heat absorbed from the lights 230*a*-236*a*. At least some of the fins of the second light bar portion 320 may face the vents 250 of the second housing portion 204. Heat dissipated by the fins can be vented through the vents 250. The second light bar portion 320 may be made from any suitable material that provides sufficient head dissipation, including, but not limited to aluminum alloy, copper, other metal or alloy, ceramic or composite material. In some arrangements, the fins on the second light bar portion 320 can dissipate heat from the light elements (e.g., the lights 230*a*-236*a*) on the first light bar portion 310. The second light bar portion 320 (with the heat fins and the extensions 340*a* and 340*b*) may be made as a single, unitary structure to better transfer and dissipate heat from the light elements.

As shown, the first light bar portion 310 and the second light bar portion 320 may be separate pieces joined via suitable connectors (e.g., screws). For example, the first light bar portion 310 may have one or more flat rear surfaces that engages one or more flat front surfaces of the second light bar portion 320, to maximize surface contact and heat conduction between the first light bar portion 310 and the second light bar portion 320. In other implementations, the first light bar portion 310 and the second light bar portion 320 may be formed as a single, unitary structure instead of separate components.

In some arrangements, the second light bar portion 320 may have an extension 340*a* extending from a top end of the second light bar portion 320. In some arrangements, the second light bar portion 320 may have another extension 340*b* extending from a bottom end of the second light bar portion 320, in alignment with the extension 340*a* along an axis of rotation, or pivot axis. Each extension 340*a* or 340*b* may be a cylindrical or shaft-shaped extension. The extensions 340*a* and 340*b* as well as the second light bar portion 320 may have an axial hole 345 that provide a passage through which one or more wires may extend, to provide power or control signals (or both) to the light elements 230*a*-236*a*. The axial hole 345 can allow the light bar 220*a* to twist without straining the wire. In some arrangements, axial hole 345 can be filled with Silicon or another suitable sealant to waterproof (e.g., achieving the IP64 standard) the entire light bar 220*a*. The extensions 340*a* and 340*b* rotatably couple the second light bar portion 320 (and the corresponding light bar 220*a* or 220*b*) to the housing (composed of first and second housing portions 202 and 204), to allow rotation of the second light bar portion 320 (and the corresponding light bar 220*a* or 220*b*) about the axis of rotation (or pivot axis). Accordingly, the housing supports the light bars 220*a* and 220*b* for rotation (or pivotal motion), via extensions 340*a* and 340*b*.

A shock absorber 330*a* may be arranged on the extension 340*a*, or between the extension 340*a* and the housing. A shock absorber 330*b* may be arranged on the extension 340*b*, or between the extension 340*b* and the housing. In particular, each shock absorber 330*a* or 330*b* may surround at least a portion of each extension 340*a* or 340*b*, respectively. Each shock absorber 330*a* or 330*b* may be an O-ring, a bushing, a grommet, and/or the like. Each shock absorber 330*a* or 330*b* may be made from rubber, foam (e.g., Styrofoam®), polystyrene, or another resilient, flexible material. In some arrangements, one or more springs can be used as a shock absorber 330*a* or 330*b*.

In some arrangements, each shock absorber 330*a* or 330*b* may be rotatably coupled to the light bar 220*a*, on each extension 340*a* or 340*b*, respectively, for relative rotation between the extensions 340*a* and 340*b* and the shock absorbers 330*a* and 330*b*. In such arrangements, the shock absorbers 330*a* and 330*b* can be fixed with respect to the housing, or the shock absorbers 330*a* and 330*b* can be rotatably supported by the housing.

Figure 3G:
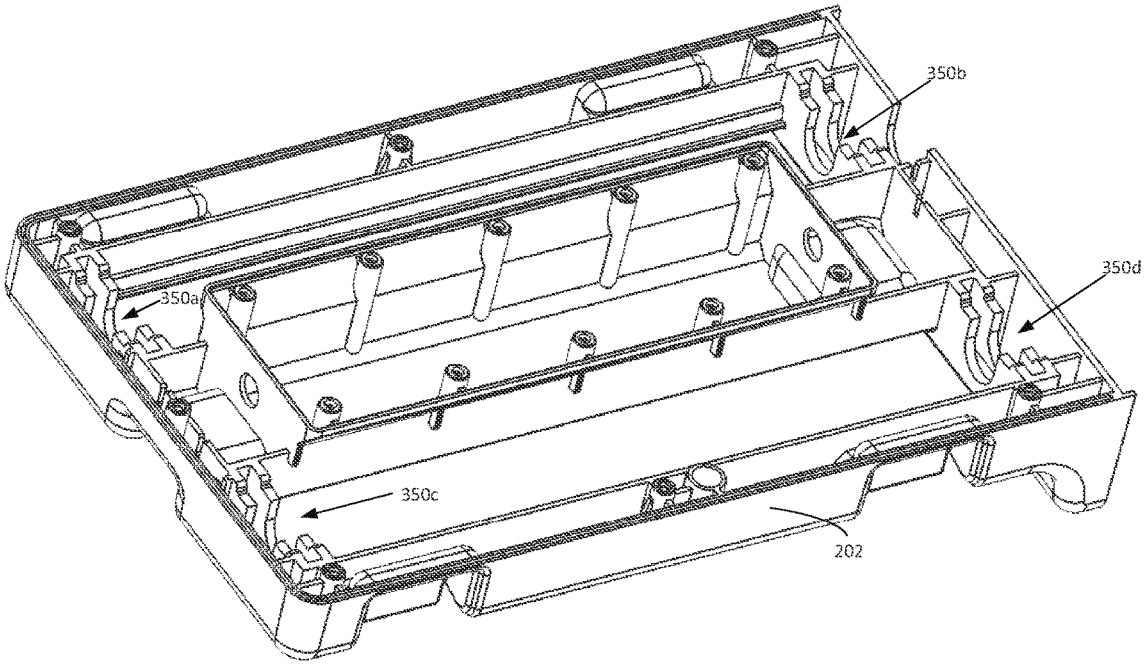
FIG. 3G shows a perspective view of the first housing portion (FIGS. 2A-2F) according to some implementations.
Figure 3H:
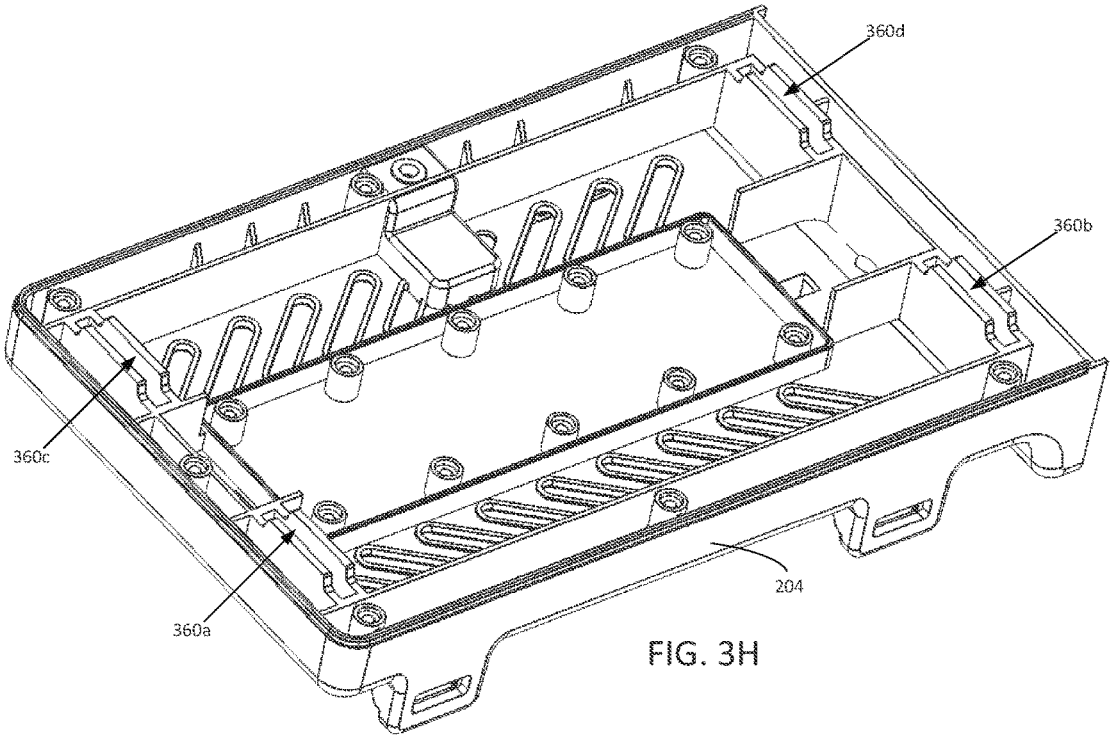
FIG. 3H shows a perspective view of the second housing portion (FIGS. 2A-2F) according to some implementations.

In some arrangements, each shock absorber 330*a* or 330*b* may be fixed relative to each extension 340*a* or 340*b*, respectively. In such arrangements, each shock absorber 330*a* or 330*b* may be rotatable relative to the housing, to allow rotation of the first and second light bar portions 310 and 320 relative to the housing. FIG. 3G shows a perspective view of the first housing portion 202 (FIGS. 2A-2F) according to some implementations. FIG. 3H shows a perspective view of the second housing portion 204 (FIGS. 2A-2F) according to some implementations. In the non-limiting example shown in FIGS. 1-3H, each of the first housing portion 202 and the second housing portion 204 may include support structures (e.g., grooves 350*a*-350*d* and 360*a*-360*d*) for rotatably supporting shock absorbers (e.g., the shock absorbers 330*a* and 330*b*). For example, the grooves 350*a*-350*d* and 360*a*-360*d* may be large enough to allow the shock absorbers 330*a* and 330*b* to rotate therein. The grooves 350*a*-350*d* and 360*a*-360*d* may be further configured to engage a retaining (protruding) portion of the shock absorbers 330*a* and 330*b* to hold the shock absorbers 330*a* and 330*b* in place.

Each shock absorber 330*a* or 330*b* is arranged between the housing (e.g., in the grooves 350*a*-350*d* and 360*a*-360*d*) and the light bar 220*a* (e.g., the extension 340*a* or 340*b*, respectively) to absorb shock. In other words, the shock absorbers 330*a* or 330*b* can provide shock or vibration isolation suspension for the light bar 220*a*, to minimize vibration and damage to the light bar 220*a*. For instance, in the event that the light unit 200 falls to the ground, the shock felt by the housing can be at least reduced by the shock absorbers 330*a* and 330*b*. In this manner, the light bar 220*a* and especially the lights 230*a*-236*a* can be protected.

Each shock absorber 330*a* or 330*b* may provide a friction fit or frictional engagement with one or more of the housing (e.g., the grooves 350*a*-350*d* and 360*a*-360*d*) or the light bar 220*a* to allow manual pivoting motion of the light bar 220*a*, yet provide sufficient frictional force to hold the light bar 220*a* in an adjusted pivotal position, after the light bar 220*a* has been adjustably moved. Each shock absorber 330*a* or 330*b* may generate a threshold friction force to resist movement of the light bar 220*a* such that non-user manipulation or unintended manipulation such as, but not limited to, certain accidental bumping or contact of the housing, wind, gravity, and the like are not be sufficient to cause the light bar 220*a* to pivot.

Illustrating with a non-limiting example in which the shock absorbers 330*a* and 330*b* rotatably support the extensions 340*a* and 340*b*, an inner surface of each shock absorber 330*a* or 330*b* facing the light bar (e.g., the extension 340*a* or 340*b*, respectively) frictionally engages an outer surface of each of the extensions 340*a* and 340*b*, to hold the light bar 220*a* (or 220*b*) in place (at a set rotary or pivoted position) after being manipulated by a user. Illustrating with a non-limiting example in which the shock absorbers 330*a* and 330*b* are rotatably supported by the housing (e.g., the grooves 350*a*-350*d* and 360*a*-360*d*), an outer surface of each shock absorber 330*a* or 330*b* facing the housing (e.g., one or both of the first housing portion 202 and the second housing portion 204) frictionally engages a surface on the grooves 350*a*-350*d* and 360*a*-360*d*, to hold the light bar 220*a* (or 220*b*) in place after being manipulated by a user.

Figure 4A:
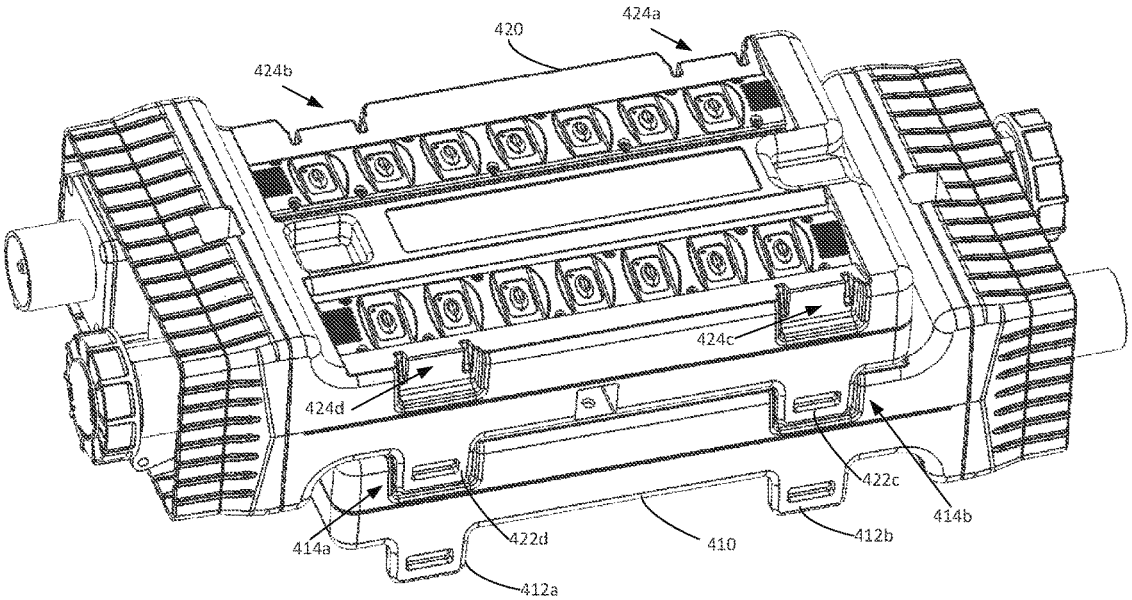
FIG. 4A shows a perspective view of light units arranged in a stacked configuration according to some implementations.
Figure 4B:
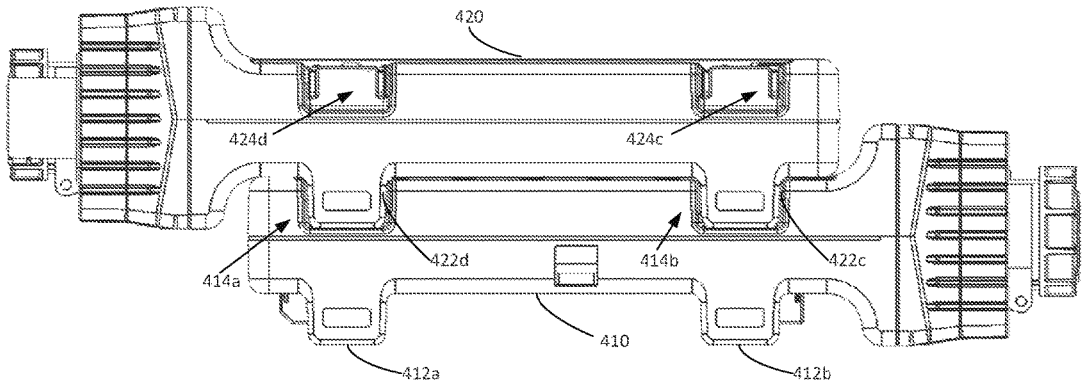
FIG. 4B shows a first side view of light units arranged in a stacked configuration according to some implementations.
Figure 4C:
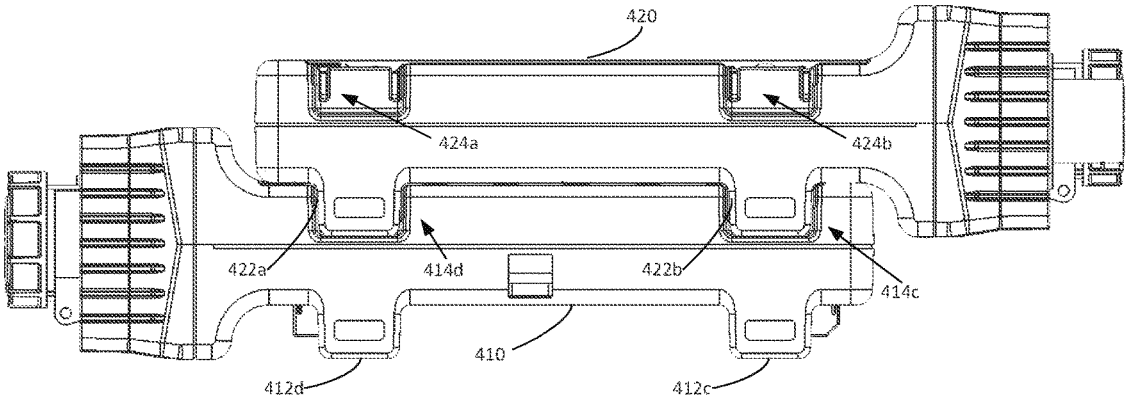
FIG. 4C shows a second side view of light units arranged in a stacked configuration according to some implementations.

FIG. 4A shows a perspective view of light units 410 and 420 arranged in a stacked configuration 400 according to some implementations. FIG. 4B shows a first side view of light units 410 and 420 arranged in a stacked configuration 400 according to some implementations. FIG. 4C shows a second side view of light units 410 and 420 arranged in a stacked configuration 400 according to some implementations. Referring to FIGS. 1-4C, each of the light units 410 and 420 may be the light unit 200 in some arrangements. For example, the light unit 410 may include grooves 414*a*-414*d* (214*a*-214*d*) and extensions 412*a*-412*d* (212*a*-212*d*). The light unit 420 may include grooves 424*a*-424*d* (214*a*-214*d*) and extensions 422*a*-422*d* (212*a*-212*d*).

As shown, the light units 410*a* and 410*b* are configured to fit with one another in the stacked configuration 400. For instance, the grooves 414*a*-414*d* of the light unit 410 are configured to engage and mate with the extensions 422*a*-422*d* of the light unit 420 such that when the extensions 422*a*-422*d* of the light unit 420 is received by or inserted into the grooves 414*a*-414*d* of the light unit 410, the light units 410 and 420 can be held in a relatively stable stack, to be transported or stored together. Such features can assure that the light units 410*a* and 410*b* stay horizontal on a surface as a single unit and to locate other light units (not shown) on top in the stack. As shown, a direction (e.g., Y) in which the light units 410 and 420 are stacked is transverse to the pivot axes (e.g., $X_1$-$X_4$) of light bars on each light unit 410 or 420. While FIGS. 4A-4C show two stacked light units 410*a* and 410*b*, in other examples, three or more light units may be stacked together in a similar manner.

The various examples illustrated and described are provided merely as examples to illustrate various features of the claims. However, features shown and described with respect to any given example are not necessarily limited to the associated example and may be used or combined with other examples that are shown and described. Further, the claims are not intended to be limited by any one example.

The foregoing method descriptions and the process flow diagrams are provided merely as illustrative examples and are not intended to require or imply that the steps of various examples must be performed in the order presented. As will be appreciated by one of skill in the art the order of steps in the foregoing examples may be performed in any order. Words such as "thereafter,""then,""next," etc. are not intended to limit the order of the steps; these words are simply used to guide the reader through the description of the methods. Further, any reference to claim elements in the singular, for example, using the articles "a,""an" or "the" is not to be construed as limiting the element to the singular.

The various illustrative logical blocks, modules, circuits, and algorithm steps described in connection with the examples disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The hardware used to implement the various illustrative logics, logical blocks, modules, and circuits described in connection with the examples disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In some exemplary examples, the functions described may be implemented in hardware, software, firmware, or any combination thereof. If implemented in software, the functions may be stored as one or more instructions or code on a non-transitory computer-readable storage medium or non-transitory processor-readable storage medium. The steps of a method or algorithm disclosed herein may be embodied in a processor-executable software module which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable storage media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout the previous description that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

The invention claimed is:

1. A lighting system comprising at least one light unit and one or more additional light units, each light unit and additional light unit comprising:

a housing;

at least two light bars supported by the housing, wherein:

each respective light bar comprises one or more light elements configured to direct light in a light field associated with the respective light bar; and each respective light bar is supported for pivotal motion relative to the housing, about a respective pivot axis, to adjustably move the light field associated with the respective light bar in a direction that is non-parallel to the pivot axis of the respective light bar; and an electrical connection to provide power to the one or more light elements of each respective light bar; and the lighting system further comprising at least one wire configured to connect to the electrical connection of each light unit and each additional light unit in a daisy chain connection configuration, to pass the power to the one or more lights of the light unit and to the one or more lights of each of the one or more additional light units.

2. The lighting system of claim 1, wherein one or more light elements of each respective light bar comprises an array of two or more light elements arranged in a row along or parallel to the pivot axis.

3. The lighting system of claim 1, further comprising shock absorbers between the housing and the light bars, wherein each shock absorber is configured to hold and suspend the light bar in at least partial vibration isolation relative to the housing, to reduce transfer of shock from the housing to the light bar.

4. The lighting system of claim 3, wherein each shock absorber frictionally engages one or more of the housing or one of the light bars sufficient to allow manual pivotal adjustment of each respective light bar relative to the housing, and to provide sufficient frictional force to hold an adjusted pivotal position of each respective light bar after the manual pivotal adjustment.

5. The lighting system of claim 3, wherein:

the light bar further comprises a heat sink;

the heat sink comprises at least one extension; and the shock absorber surrounds at least a portion of each of the at least one extension.

6. The lighting system of claim 5, wherein the at least one extension has a hole providing a passage through which an electrical wire extends.

7. The lighting system of claim 1, wherein a first light bar of the at least two light bars is pivotally adjustable about a first pivot axis to adjust a first light field;

a second light bar of the at least two light bars is pivotally adjustable about a second pivot axis to adjust a second light field; and the first pivot axis is parallel to the second pivot axis.

8. The lighting system of claim 7, wherein:

the first light bar and the second light bar are configured to be pivotally adjusted to overlap the first light field and the second light field to narrow a combined light field; and the combined light field comprising the first light field and the second light field.

9. The lighting system of claim 7, wherein:

the first light bar and the second light bar are configured to be pivotally adjusted such the first light field and the second light field move away from one another to broaden a combined light field; and the combined light field comprising the first light field and the second light field.

10. The lighting system of claim 1, wherein the housing of the light unit and the housing of each of the one or more additional light units are configured to fit with one another in a stacked configuration.

11. A lighting system comprising at least one light unit and one or more additional light units, each light unit and additional light unit comprising:

a housing;

at least two light bars supported by the housing, wherein:

each respective light bar comprises one or more light elements configured to direct light in a light field associated with the respective light bar; and each respective light bar is supported for pivotal motion relative to the housing, about a respective pivot axis, to adjustably move the light field associated with the respective light bar in a direction that is non-parallel to the pivot axis of the respective light bar; and an electrical connection to provide power to the one or more light elements of each respective light bar;

wherein the housing of the light unit and the housing of each of the one or more additional light units are configured to fit with one another in a stacked configuration; and wherein the housing of the light unit and the housing of each of the one or more additional light units are configured to structurally mate with one another via extensions and grooves on the housing of the light unit and the housing of each of the one or more additional light units.

12. The lighting system of claim 11, wherein the housing of the light unit and the housing of each of the one or more additional light units are configured to be stacked in an axis transverse to the pivot axis of the respective light bar of each of the light unit and the one or more additional light units.

13. The lighting system of claim 1, further comprising a stand configured to support the light unit.

14. The lighting system of claim 1, the pivotal motion corresponds to user manipulation.

15. A method for providing a lighting system, comprising:

providing a light unit; and providing at least one additional light unit, wherein providing the light unit and wherein providing each additional light unit comprises:

providing a housing;

providing at least two light bars supported by the housing, wherein:

each respective light bar comprises one or more light elements configured to direct light in a light field associated with the respective light bar;

each respective light bar is supported for pivotal motion about a respective pivot axis and relative to the housing, to adjustably move the light field associated with the respective light bar in a direction that is non-parallel to the pivot axis of the respective light bar; and providing an electrical connection configured to provide power to the one or more light elements of each respective light bar; and the method further comprising configuring at least one wire to connect to the electrical connection of each light unit and each additional light unit to pass the power to the one or more lights of the light unit and to the one or more lights of each of the one or more additional light units.

16. The lighting system of claim 1, wherein the at least one wire is configured to connect a power source to the electrical connection of each light unit and each additional light unit, to pass the power to each light unit and each additional light unit.

17. The lighting system of claim 1, wherein each light unit and each additional light unit has a second electrical connection to connect and pass power to at least one other light unit or additional light unit of the one or more light units or one or more additional light units.

18. The lighting system of claim 1, wherein the at least one wire comprises a plurality of wire sections, each wire section being configured to connect to the electrical connection of a respective one of the light units or additional light units, and to the second electrical connection of a next one of the light units or additional light units in the daisy chain connection configuration.

19. The lighting system of claim 1, the at least one wire further comprises an additional wire section configured to connect a power source to the electrical connection of one of the light units.

20. The lighting system of claim 1, further comprising a plurality of shock absorbers including a shock absorber arranged between the housing and each light bar, wherein each shock absorber is frictionally engaged with and rotatable relative to either the housing or one of the light bars, and each shock absorber is engaged for rotation with the other of the housing or the light bar.

* * * * *